United States Patent [19]

McCubbin et al.

[11] 3,992,997

[45] Nov. 23, 1976

[54] WARHEAD CASING

[75] Inventors: Melvin J. McCubbin; Clifford T. Johnson; Curtis V. Nakaishi, all of China Lake, Calif.

[73] Assignee: The United States of America as represented by the Secretary of the Navy, Washington, D.C.

[22] Filed: Mar. 31, 1975

[21] Appl. No.: 563,748

[52] U.S. Cl. ..... 102/56 R; 102/105
[51] Int. Cl.[2] ..... F42B 15/00; F42B 13/12
[58] Field of Search ..... 102/56, 105; 252/8.1

[56] References Cited

UNITED STATES PATENTS

| | | | |
|---|---|---|---|
| 3,130,940 | 4/1964 | Erb et al. | 102/105 |
| 3,152,548 | 10/1964 | Schwartz | 102/105 |
| 3,654,190 | 4/1972 | Levine | 252/8.1 |
| 3,830,666 | 8/1974 | Schneider | 102/105 |

OTHER PUBLICATIONS

*Growth Potential Defined For Heat Sink, Ablation Shields*, reprinted from Aviation Week, Sept. 7, 1959.

*Primary Examiner*—Verlin R. Pendegrass
*Attorney, Agent, or Firm*—R. S. Sciascia; Roy Miller; Gerald F. Baker

[57] ABSTRACT

A warhead casing is designed to protect the high explosive material therein from open fires or other sources of intense heat which might cause premature explosion of the warhead. The warhead casing is relieved throughout the greater part of its outer circumference and may be then counter-relieved over a slightly lesser distance. The relieved area is filled with an ablative material covered by a protective intumescent coating, for example, of fire resistant, impregnated cloth.

6 Claims, 1 Drawing Figure

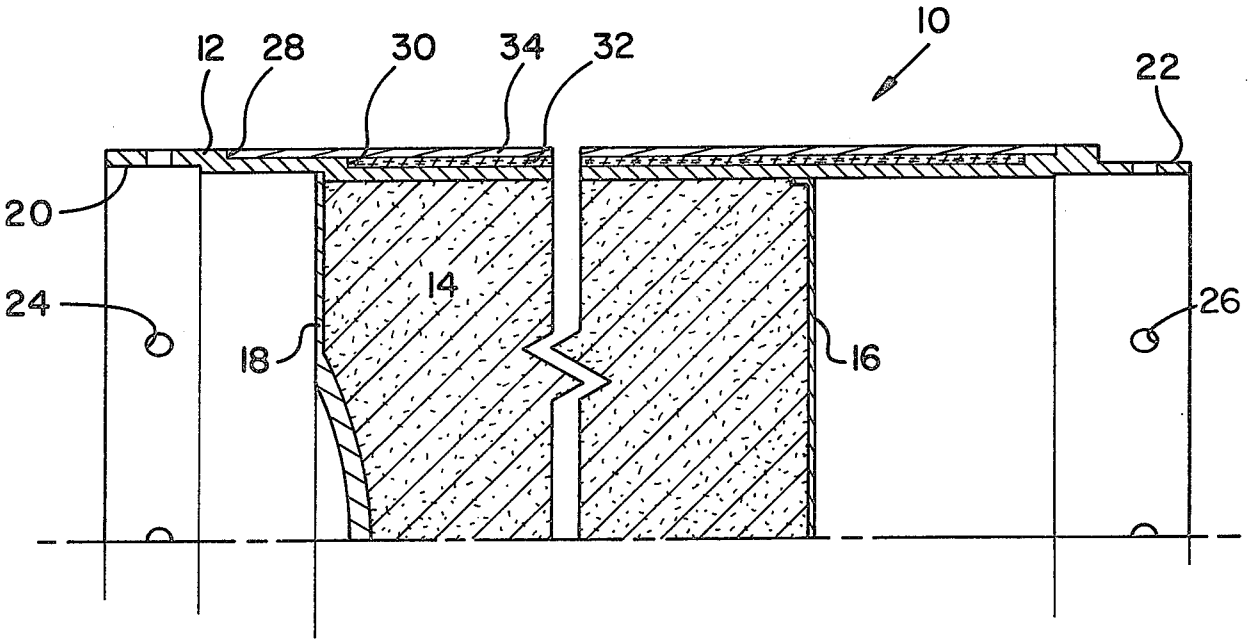
10
12
14
16
18
20
22
24
26
28
30
32
34

WARHEAD CASING

CROSS REFERENCE TO RELATED APPLICATION

The warhead casing according to the present invention is especially suited for use in a guided missile warhead such as that disclosed in Assignee's prior U.S. Pat. No. 3,498,224 issued Mar. 3, 1970.

BACKGROUND OF THE INVENTION

When fires occur in bomb storage areas or in areas where aircraft, for example, are parked with bombs on board, attempts to extinguish the flames can place personnel in grave danger from exploding bombs. Munitions makers have long been acquainted with this problem and have devised tests known as "fast cook-off tests" and "slow cook-off tests" and other means for testing various materials and devices and the various explosive candidates in an effort to find combinations with an acceptable reaction to heating.

These prior efforts to counter the effects of heating have met with success only at the expense of warhead lethality, warhead volume or other impairment of efficiency in the all-up round.

SUMMARY

According to the present invention, a warhead casing is provided which insulates and protects a high explosive warhead from heat generated, for example, in a fuel fire without sacrificing warhead dimensions and at the same time, preserving the integrity of the outer surface of the missile in which it is incorporated.

BRIEF DESCRIPTION OF THE DRAWING

The sole FIGURE on the drawing is a partial longitudinal cross-sectional view of a missile warhead section incorporating the invention.

DESCRIPTION OF THE INVENTION

The warhead section of a guided missile, for example, is illustrated generally by the numeral 10 on the drawing. The warhead as shown consists essentially of a casing 12 surrounding an explosive material 14 confined between two bulkheads 16 and 18 attached to the casing. The warhead casing has surfaces 20, 22 with a number of holes 24, 26 therein and which surfaces and holes facilitate the attachment of the warhead section to other parts of a guided missile, for example.

The casing 12 of section 10 may be machined from one piece of tubular material and is shown thus on the drawing. Obviously, however, the casing could be manufactured from a number of parts and welded or otherwise joined in the configuration shown. A typical casing is formed of steel plate with the thickness in the region surrounding explosive 14 being about 3/16 inch.

The outer periphery of casing 12 is relieved or recessed and may advantageously be formed in two steps 28, 30. The area encompassed within the step 30 in the illustrated embodiment is filled with an ablative material to approximately the height of the step and the remaining space is filled with a wrap of impregnated fire resistant, preferably intumescent, material.

A particularly effective ablative material comprises a granulated cork bonded with a synthetic resin binder. Materials of this type are known and have been adapted for use as thermal and ablative insulation on missile surfaces, and other aerospace applications. A good example of such a material is commercially available from Armstrong Cork Company, as Number 2755 Insulcork.

The outer fire resistant layer is advantageously formed of a glass fiber material impregnated with a curable epoxy adhesive. The impregnated glass fabric is applied in layers until the outer surface is flush with the outer contour of the casing 12. After curing and painting, the outer surface of the insulative area is coincidental in all dimensions with the outer skin of the missile presenting no aerodynamic anomolies. Other ablatives materials such as carbon or asbestos may be used for the inner insulation and other high temperature resistant protective materials may be used for the outer coating material. The entire missile is preferably covered with an intumescent paint.

Cook-off tests at the Naval Weapons Center, China Lake, California, have indicated that the combination of the coating of ablative material with the overlapping protective coating of intumescent material have been effective to prevent high order explosion of the warheads tested in an open flame environment. Based on these tests, it is projected that the warhead will be protected from premature explosion because of any aerodynamic heating effects which might be encountered by the missile in flight.

It is anticipated that other suitable materials may be substituted for the materials described above without departing from the spirit of Applicant's invention. Thus, the inner layer may be replaced with carbonized asbestos or a 94 mil thickness of tetrafluoroethylene (Teflon); and the outer layer by a light metal such as, for example, 40 mil aluminum sheet.

Although the relieved portion of casing 12 has been shown in a definite stepped pattern, it is contemplated that other configurations may be found effective.

What is claimed is:

1. In a thermal insulation system in combination with a missile skin or the like for the protection of explosive material in the warhead section of the missile from the effects of aerodynamic heating or open fires, the combination comprising:

a substantially cylindrical web of metal forming a warhead casing;

said casing being centrally relieved or recessed in steps forming inner and outer areas between steps;

an inner layer of insulative material filling the inner area next to said metal casing; and an outer layer of fire resistant material filling said outer area between steps;

the system being so constructed and arranged that the warhead section as a whole presents an outer surface coincidental in dimensions with the outer skin of the remainder of the missile.

2. The system of claim 1 wherein said inner layer consists essentially of an ablative material and said outer layer comprises a glass fiber material impregnated with an epoxy adhesive.

3. The system of claim 2 wherein said inner layer consists essentially of granulated cork bonded with a synthetic resin binder.

4. The system of claim 2 wherein said inner layer consists essentially of carbonized asbestos.

5. The system of claim 2 wherein the outer surface of said outer layer is covered with a coating of intumescent paint.

6. The system of claim 1 wherein the outer surface of said outer layer is covered with a coating of intumescent paint.

* * * * *